US010927529B2

(12) United States Patent
Cleophas

(10) Patent No.: US 10,927,529 B2
(45) Date of Patent: Feb. 23, 2021

(54) SNAIL TOOTH

(71) Applicant: IHC Holland IE B.V., Sliedrecht (NL)

(72) Inventor: Eugenius Petrus Elisabeth Marie Cleophas, Rotterdam (NL)

(73) Assignee: IHC Holland IE B.V., Sliedrecht (NL)

( * ) Notice: Subject to any disclaimer, the term of this patent is extended or adjusted under 35 U.S.C. 154(b) by 281 days.

(21) Appl. No.: 15/766,370

(22) PCT Filed: Oct. 13, 2016

(86) PCT No.: PCT/NL2016/050705
§ 371 (c)(1),
(2) Date: Apr. 6, 2018

(87) PCT Pub. No.: WO2017/065608
PCT Pub. Date: Apr. 20, 2017

(65) Prior Publication Data

US 2018/0291591 A1 Oct. 11, 2018

(30) Foreign Application Priority Data

Oct. 14, 2015 (NL) ..... 2015612

(51) Int. Cl.
*E02F 9/28* (2006.01)

(52) U.S. Cl.
CPC ..... *E02F 9/2858* (2013.01); *E02F 9/2866* (2013.01)

(58) Field of Classification Search
CPC ..... E02F 9/2858; E02F 9/2866; E02F 9/2825; E02F 9/2816; E02F 9/2808; E02F 9/2875; E21C 35/19
See application file for complete search history.

(56) References Cited

U.S. PATENT DOCUMENTS 1,519,101 A * 12/1924 Armstrong Edwin J ..... E02F 9/2816 37/452
2,213,925 A 9/1940 Van Buskirk
3,300,883 A 1/1967 Petersen et al.
3,349,508 A 10/1967 Petersen
3,820,849 A * 6/1974 Lundstrom et al. .... E21C 35/19 299/108
4,261,620 A * 4/1981 Troxler ..... E21B 10/58 299/113

(Continued)

FOREIGN PATENT DOCUMENTS

AU 416072 B1 7/1967
EP 2966228 A1 1/2016

(Continued)

*Primary Examiner* — Jamie L McGowan
(74) *Attorney, Agent, or Firm* — N.V. Nederlandsch Octrooibureau; Catherine A. Shultz; Katelyn J. Bernier

(57) ABSTRACT

A tooth for a cutter head includes a tooth body portion for connecting to an adapter; and a pick point portion comprising an end portion with a substantially planar surface, sides extending in an outward direction from the end portion to the tooth body, and a front and/or back with curvature which expands in thickness from the end portion to the tooth body portion. The tooth body portion and the pick point portion have a rounded cross-section comprising a central beam with a bottom base extending perpendicular from the beam at a lower end of the beam and a top shoulder on an upper end of the beam.

19 Claims, 3 Drawing Sheets

(56) References Cited

U.S. PATENT DOCUMENTS

| | | | | | |
|---|---|---|---|---|---|
| 4,343,516 | A * | 8/1982 | Aden | E21C 35/19 | 299/106 |
| 4,542,943 | A * | 9/1985 | Montgomery, Jr. | E02F 9/2866 | 299/102 |
| 4,625,439 | A * | 12/1986 | Johansson | E02F 9/2833 | 172/713 |
| 4,642,920 | A * | 2/1987 | Lehnhoff | E02F 9/2866 | 37/452 |
| 6,854,810 | B2 * | 2/2005 | Montgomery, Jr. | E21C 35/197 | 299/102 |
| 7,694,443 | B2 * | 4/2010 | Gabela | E02F 9/2825 | 299/102 |
| 8,166,678 | B2 * | 5/2012 | Martinez | E02F 9/2825 | 37/452 |
| D699,269 | S * | 2/2014 | Whittaker | D15/29 | |
| 8,857,917 | B2 * | 10/2014 | Bookhamer | E21C 35/19 | 299/102 |
| 2007/0245602 | A1 * | 10/2007 | Gabela | E02F 9/2825 | 37/454 |

FOREIGN PATENT DOCUMENTS

| | | | |
|---|---|---|---|
| WO | 9720111 | A1 | 6/1997 |
| WO | 2005026453 | A2 | 3/2005 |
| WO | 2012006664 | A1 | 1/2012 |
| WO | 2014086896 | A2 | 6/2014 |

* cited by examiner

SNAIL TOOTH

BACKGROUND

During dredging operations tooth systems and teeth are subject to large cutting forces (e.g., when hitting a piece of hard rock), which results in large material stresses and eventually causes teeth to wear down and/or break off. Additionally, pick points on teeth can lose their sharpness from the cutting process, and after some time the wear area becomes such a size that penetration of soil or rock during a dredging operation is more difficult or sometimes even impossible.

One method which has been used in the past to increase tooth life despite this wear and tear is to extend a wear length of the tooth. However, this results in an increased bending moment, and therefore the strength of the tooth decreases.

SUMMARY

According to a first aspect of the invention, a tooth for a cutter head comprises a tooth body portion for connecting to an adapter; and a pick point portion comprising an end portion with a substantially planar surface, sides extending in an outward direction from the end portion to the tooth body, and a front and/or back with curvature which expands in thickness from the end portion to the tooth body portion. The tooth body portion and the pick point portion have a rounded cross-section comprising a central beam with a bottom base extending perpendicular from the beam at a lower end of the beam and a top shoulder on an upper end of the beam.

Such a tooth can provide a strong cutting surface for a cutting operating. Curvature in the body can help to transfer cutting forces smoothly to the mounting portion of the tooth, and the cross-sectional shape can ensure a strong effective cutting edge even when the tooth experiences wear through use. This can result in a tooth with a longer effective lifespan.

According to an embodiment, the bottom base is wider than the top shoulder.

According to an embodiment, the cross-sectional area increases from the pick point end portion to the tooth body portion. This can ensure proper strength of tooth, and resistance to forces which might otherwise prematurely break the tooth.

According to an embodiment, the top shoulder is rounded.

According to an embodiment, the tooth body portion and the pick point portion have mirrored sides. This mirrored expansion can help to absorb and transfer forces as well as maintain a relatively constant wear area for effective cutting.

According to an embodiment, the tooth body portion connects to an adapter by sliding into the adapter. This can be through sliding into the adapter longitudinally.

According to an embodiment, the sides extend from the pick point end portion to the tooth body portion to increase the width of the tooth by about 250%.

According to an embodiment, the front comprises a first curve in a first direction and a second curve in a second direction. Optionally, the radius of curvature of the first curve is about the same as the radius of curvature of the second curve. Such curves can help to smoothly transfer forces from the pick point to the mounting portion of the tooth, helping to avoid premature breakage of the tooth.

According to an embodiment, the back comprises a first curve in a first direction and a second curve in a second direction. Optionally, the radius of curvature of the second curve is about 0.2 times the radius of curvature of the first curve. Such curves on the back can help to smoothly transfer forces from the pick point to the mounting portion of the tooth, helping to avoid premature breakage of the tooth.

According to an embodiment, front and/or the back comprise S-curvature.

According to an embodiment, the back is a rake surface.

According to an embodiment, the tooth body portion maintains a constant cross-section. Such a constant cross-section can act as a strong and stable base, connecting tooth to an adapter for transfer and absorption of forces.

According to an embodiment, the curvature on the front and/or back form a smooth transition from the pick point end portion to the tooth body portion. The smooth transition helps for the transfer of forces from the cutting edge or wear point.

According to an embodiment, the pick point portion has a wear length of about 50 mm to 200 mm.

According to an embodiment, the tooth is one integral piece.

According to an embodiment, the front and the back have curvature which expands in thickness from the end portion to the tooth body portion. Curvature on both the front and the back can help to easily transfer forces on each side to the tooth body portion from the pick point.

According to an embodiment, a tooth system for a cutter head comprises an adapter with a receiving portion; and a tooth according to any of the preceding claims, wherein the receiving portion is complementary to the tooth body portion, such that the adapter engages the tooth body portion when inserted into the receiving portion. Such a tooth with an adapter is able to smoothly transfer forces from the tooth to the adapter, making for a more effective longer lasting tooth system.

According to an embodiment, a cutter head comprises such a tooth system.

According to a further aspect of the invention, a method of connecting a tooth to an adapter comprises engaging a tooth with an adapter by sliding a tooth body portion into a complementary shaped adapter receiver space, wherein the tooth body portion comprises a cross-section comprising a central beam with a with a bottom base extending perpendicular from the beam at a lower end of the beam and a top shoulder on an upper end of the beam, and the tooth further comprises a pick point portion with a cross-sectional shape comprising a central beam with a bottom base and a top shoulder, an end portion with a substantially planar surface, sides extending in an outward direction from the end portion to the tooth body, and a front and/or back with a curvature which expands in thickness from the end portion to the tooth body portion. Such a method can result in a tooth with an adapter that is able to perform well despite wear, resist premature breakage and have a long effective working life.

DETAILED DESCRIPTION

Figure 1A:
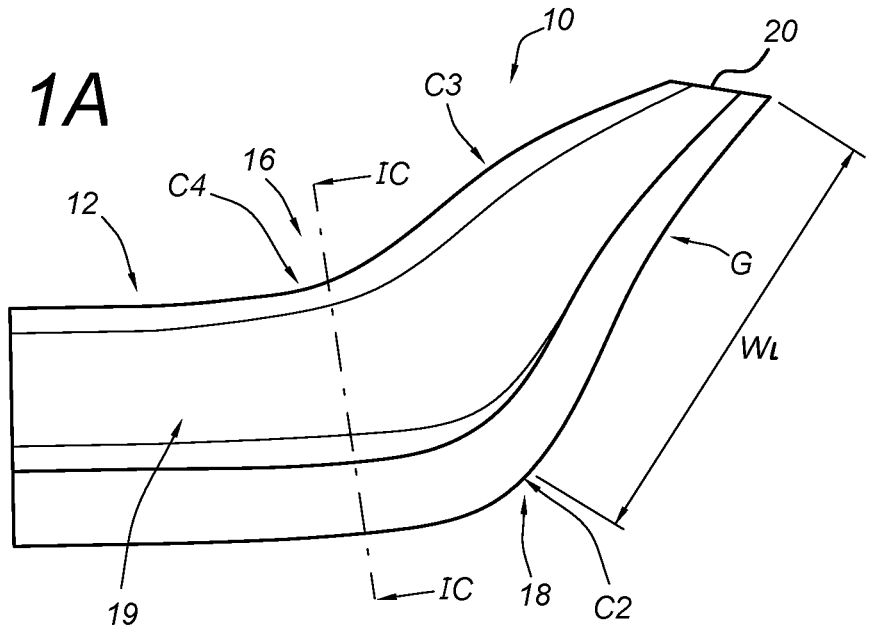
FIG. 1A is a side view of a tooth.
Figure 1B:
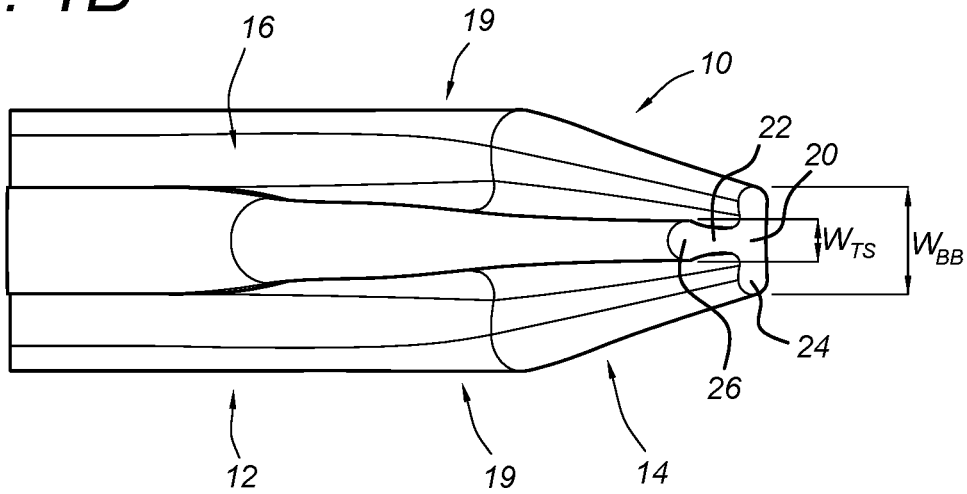
FIG. 1B is a top view of the tooth of FIG. 1A.
Figure 1C:
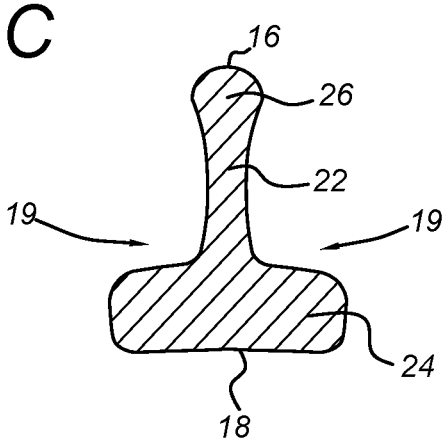
FIG. 1C shows a cross-sectional view of the tooth of FIG. 1A through line C-C.

FIG. 1A is a side view of tooth 10, and FIG. 1B is a top view of tooth 10. Tooth 10 includes tooth body portion 12, pick point portion 14, front 16, back 18, sides 19 and end portion 20. Cross-section, as can be seen in end portion 20 and cross-section show in in FIG. 1C, includes a central beam 22 with a bottom base 24 and rounded top shoulder 26. Back 18 can be the rake surface of tooth 10.

Tooth 10 includes a snail like shape with the cross-sectional area increasing from pick point end portion 20 to tooth body portion 12. Cross-section remains substantially constant throughout tooth body portion 12. Sides 19 are mirrored, and extend outward to expand the tooth in thickness from front 16 to back 18 and in width between sides 19 from end portion 20 to tooth body portion 12. Tooth 10 includes a double curvature in front 16 and back 18 from end portion 20 to tooth body portion 12. This curvature can be s-shaped curvature or another type of curvature. The radius of curvature on front 16 and back 18 can vary, and can, for example, have ratios of: $C_2=0.2\times C_1$; $C_3=0.5\times C_1$; $C_4=0.5\times C_1$.

Bottom base 24 extends substantially perpendicular at one end of central beam 22, with central beam 22 in the center of bottom base 24. Top shoulder 26 extends at the other end of central beam 22. Bottom base 24 and top shoulder 26 are typically rounded, with even the top side of top shoulder 26 being rounded. Bottom base 24 is typically wider than top shoulder 22.

Size (and dimensions) of tooth 10 will typically be determined by the size of the cutterhead (or dredgehead) which will use tooth 10, which will be determined by the size and power of the Cutter Suction Dredger (or hopper) using the cutterhead (or dredgehead). If more power is required, a larger cutting system and larger teeth 10 are used.

Acknowledging the variations depending on these requirements, example dimensions of tooth can include a width of pick point end portion at tooth bottom base 24 $W_{BB}$ being about 10 mm to 40 mm and a pick point wear length $W_L$ of about 50 mm to 200 mm. The ratio of width of top shoulder 26 $W_{TS}$ to width of bottom base 24 $W_{BB}$ can be about 3.5. Tooth can increase in width from pick point end 20 to tooth body portion 12 about 250%. While these ratios and measurements are given variations are possible, for example 30% or more and can vary depending on tooth/cutter head requirements, how the tooth wears, etc.

Tooth can be formed in one integral piece, and can be formed of a variety of materials depending on the material to be cut. Tooth 10 is shaped and formed to perform effectively in regards to sharpness, standing time and strength. The multiple curvatures, particularly on front 16 and back 18, and smooth shaped transition from pick point 14 to tooth body portion 12 helps to prevent material stresses and guide internal stresses down tooth, making it stronger. The curvature also gives tooth 10 an ideal attach shape for breaking up soil or rock in a cutting operation.

The addition of top shoulder 26 and bottom base 24 to increase the thickness on front 16 and back 18 helps to reinforce the tooth and increase strength. The increase in thickness between sides 19 throughout the whole cross-section from end portion 20 to tooth body 12 also helps reinforce tooth 10.

Figure 2A:
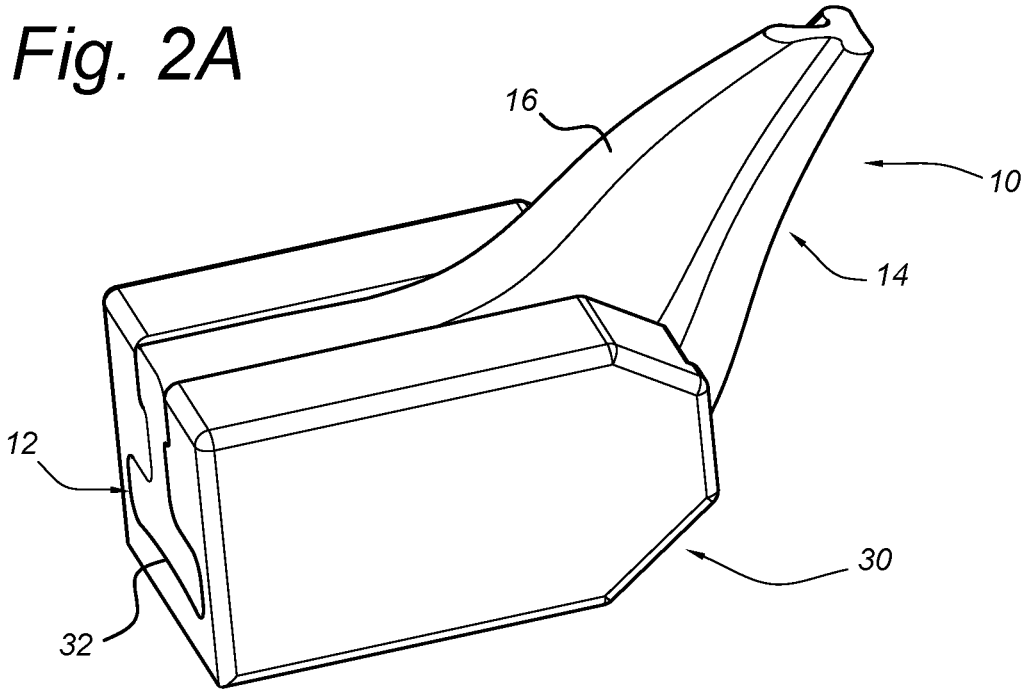
FIG. 2A is a perspective view of a tooth in an adapter.
Figure 2B:
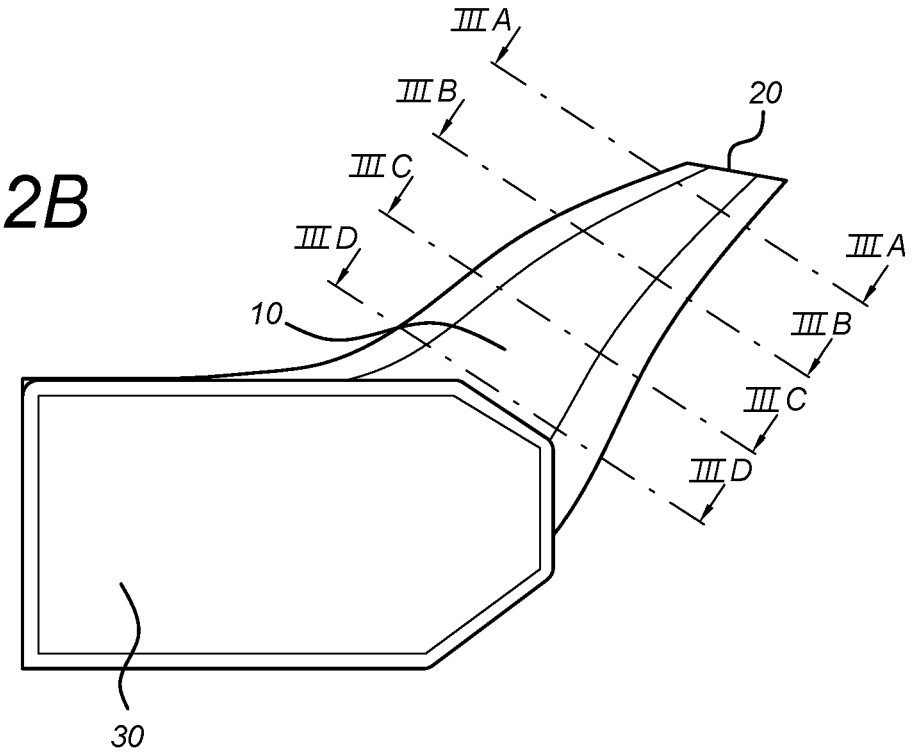
FIG. 2B is a side view of the tooth and adapter of FIG. 2A.
Figure 2C:
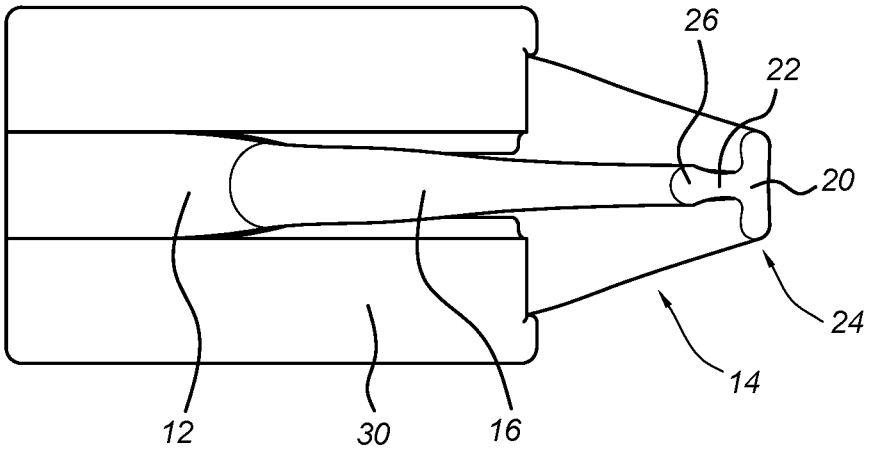
FIG. 2C is a top view of the tooth and adapter of FIG. 2A.
Figure 3A:
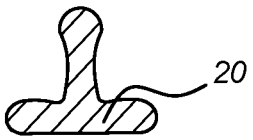
FIGS. 3A-3D show pick point end portions at different stages of wear for the tooth of FIG. 2B.
Figure 3B:
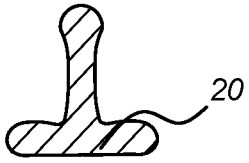
Figure 3C:
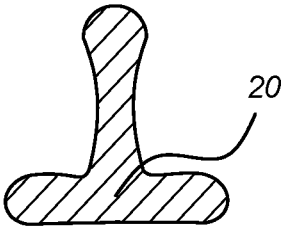
Figure 3D:
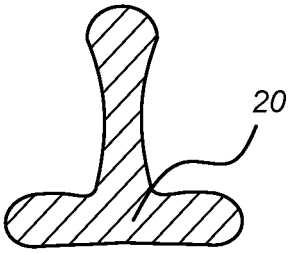

FIG. 2A is a perspective view of tooth 10 in an adapter 30, FIG. 2B is a side view of tooth 10 in adapter 30 with lines showing wear edges, FIG. 2C is a top view of tooth 10 in adapter 30, and FIGS. 3A-3D show pick point end portions 20 at the various wear edges along the lines indicated in FIG. 2B. Adapter 30 includes a receiving portion 32.

Tooth 10 slides into receiving portion 32 of adapter 30, which is complementary in shape to tooth body portion 12 so that adapter 30 engages the tooth body portion 12 when tooth 10 is inserted into adapter 10. Tooth body portion 12 sits substantially within adapter 30 when engaged, and pick point portion 14 extends out of adapter 30 for cutting.

When performing a cutting operation, tooth 10, secures into adapter 30. Tooth 10 is then moved, for example, rotated as part of a cutter head (not shown) to cut materials. Tooth 10 will be subject to wear due to the cutting operation, and various pick point end portions 20 are shown at wear stages IIIA-IIID. As can be seen, the pick point end portion 20 wear edge remains a substantially constant shape with substantially constant dimension ratios as it wears down from initial tooth 10 to wear edge shown in 3d.

Tooth 10 shape and complementary adapter receiving space shape 32 help to secure tooth 10 to adapter 30, providing a stable and secure base for a cutting operation. The central beam 22 with top shoulder 26 and bottom base 24 helps to secure tooth 10 to adapter 30 as well as provide strength and absorb forces placed on tooth 10 during a cutting operation.

By forming tooth 10 with a shape which increases in thickness and width from pickpoint end portion 20 to tooth body 12, and includes design elements to increase strength and fight against wear and breaking, tooth is able to have a long life, resist wear and absorb forces during a cutting operation. The curvature and cross-sectional shape of tooth 10 help to transfer forces smoothly down tooth 10 to tooth body portion 12 and then to adapter 30. The substantially constant profile and small wear area also promotes mostly constant wear area, resulting in a tooth that is still effective for cutting and penetration even after wear. This results in an effective, stable tooth 10 that can have a long working life, a more effective cutting area and be more resistant to premature breakage.

While tooth 10 and adapter 30 is shown with a specific shape, size and dimensions, these are for example purposes only can vary according to system and cutting requirements. This variation can be 30% or even more.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the appended claims.

The invention claimed is:

1. A tooth for a cutter head, the tooth comprising:

a tooth body portion for connecting to an adapter; and a pick point portion comprising an end portion with a substantially planar surface, sides extending in an outward direction from the end portion to the tooth body, and a front and back of the pick point portion with smooth curvature which expands in thickness from the end portion to the tooth body portion;

wherein the tooth body portion and the pick point portion have a rounded cross-section comprising a central beam with a bottom base extending perpendicular from the beam at a lower end of the beam and a top shoulder on an upper end of the beam.

2. The tooth of claim 1, wherein the bottom base is wider than the top shoulder.

3. The tooth of claim 1, wherein the cross-sectional area increases from the pick point end portion to the tooth body portion.

4. The tooth of claim 1, wherein the top shoulder is rounded.

5. The tooth of claim 1, wherein the tooth body portion and the pick point portion have mirrored sides.

6. The tooth of claim 1, wherein the sides extend from the pick point end portion to the tooth body portion to increase the width of the tooth by about 250%.

7. The tooth of claim 1, wherein the front comprises a first curve in a first direction and a second curve in a second direction.

8. The tooth of claim 7, wherein the radius of curvature of the first curve is about the same as the radius of curvature of the second curve.

9. The tooth of claim 1, wherein the back comprises a first curve in a first direction and a second curve in a second direction.

10. The tooth of claim 9, wherein the radius of curvature of the second curve is about 0.2 times the radius of curvature of the first curve.

11. The tooth of claim 1, wherein the back is a rake surface.

12. The tooth of claim 1, wherein the tooth body portion maintains a constant cross-section.

13. The tooth of claim 1, wherein the curvature on the front and/or back form a smooth transition from the pick point end portion to the tooth body portion.

14. The tooth of claim 1, wherein the pick point portion has a wear length of about 50 mm to 200 mm.

15. The tooth of claim 1, wherein the tooth is one integral piece.

16. The tooth of claim 1, wherein the front and the back have curvature which expands in thickness from the end portion to the tooth body portion.

17. A tooth system for a cutter head comprising:

an adapter with a receiving portion; and a tooth according to claim 1, wherein the receiving portion is complementary to the tooth body portion, such that the adapter engages the tooth body portion when inserted into the receiving portion.

18. A cutter head comprising a tooth system according to claim 17.

19. A method of connecting a tooth to an adapter, the method comprising:

engaging a tooth with an adapter by sliding a tooth body portion into a complementary shaped adapter receiver space, wherein the tooth body portion comprises a cross-section comprising a central beam with a with a bottom base extending perpendicular from the beam at a lower end of the beam and a top shoulder on an upper end of the beam, and the tooth further comprises a pick point portion with a cross-sectional shape comprising a central beam with a bottom base and a top shoulder, an end portion with a substantially planar surface, sides extending in an outward direction from the end portion to the tooth body, and a front and back of the pick point portion with a smooth curvature which expands in thickness from the end portion to the tooth body portion.

* * * * *